United States Patent [19]

Franch

[11] 4,188,786

[45] Feb. 19, 1980

[54] HYDRAULIC MACHINE

[76] Inventor: Gino Franch, 10, Via G. Avezzana, Milan, Italy

[21] Appl. No.: 904,263

[22] Filed: May 9, 1978

[30] Foreign Application Priority Data

May 13, 1977 [IT] Italy ..... 4829 A/77

[51] Int. Cl.[2] ..... F15B 15/18

[52] U.S. Cl. ..... 60/325; 60/369; 415/71

[58] Field of Search ..... 60/413, 435, 439, 440, 60/473, 907, 325, 369, 371; 415/70, 88, 89, 120, 71; 417/355

[56] References Cited

U.S. PATENT DOCUMENTS 1,527,474 2/1925 Faure ..... 415/70

4,069,669 1/1978 Pitkanen ..... 60/325

*Primary Examiner*—Edgar W. Geoghegan

*Attorney, Agent, or Firm*—Lowe, King, Price & Becker

[57] ABSTRACT

The hydraulic machine comprises an oscillating rotor, mounted on a machine frame, which is driven with reciprocating movement by a crank mechanism. On the oscillating rotor there is arranged an active pipe circuit filled with water, and consisting of a pipe winding the ends of which are connected, by means of flexible hose portions, to a fixed inlet and a fixed outlet. When the oscillating rotor is driven with reciprocating movement, the water contained in the active pipe circuit is subjected to a linear alternating acceleration which produces between the fixed inlet and the fixed outlet a pressure difference which varies in an almost sinusoidal manner.

9 Claims, 9 Drawing Figures

16
18
20
17
14
13
21
8
8
12

2
3
4
3
3
11
10
9
3
1
25
123
T
8

HYDRAULIC MACHINE

SUMMARY OF THE INVENTION

The present invention relates to a hydraulic machine, which can be used alternately as a pump or as a torque transducer.

Objects of the invention are to provide a machine of the above mentioned type which, when used as a pump, can generate very high pressures, and, when used as a torque transducer, in combination with a hydraulic motor which can be driven by alternating pressure, for example a hydraulic motor as described in the pending U.S. application No. 886,924 filed on Mar. 14, 1978 in the name of the same applicant, presents a very high degree of efficiency, and in which the construction and the maintenance of the sealings between moving and fixed parts of the machine does not present any problem.

In the hydraulic machine according to the invention there is provided an oscillating rotor which is rotatably mounted around a rotational axis and is driven into rotary oscillations by means of a crank mechanism. At the interior of the oscillating rotor there is mounted a so-called active pipe circuit, which is filled with a fluid and which is curved in such a manner that the projection of its longitudinal axis onto a plane perpendicular to the rotational axis of the oscillating rotor, defines a surface which increases with the length of the axis of the pipe circuit. More particularly, the active pipe circuit of the oscillating rotor consists of at least a partial pipe coil. The active circuit of the oscillating rotor is connected by its extremities, through flexible hose portions, to a fixed inlet and a fixed outlet for the fluid. Onto each point of the fluid contained in the active circuit there is exerted a linear alternating acceleration which corresponds to the product of the distance from the rotational axis of the rotor and the alternating angular acceleration produced by the rotary oscillations of the rotor. The components of the forces of inertia generated by the linear alternating acceleration, which components are directed in the direction of the longitudinal axis of the active circuit, produce between the ends of the active circuit, and more particularly between the fixed inlet and outlet, a hydraulic pressure difference which is proportional to the product of the surface delimited by the projection of the longitudinal axis of the active circuit and the angular acceleration which varies in a sinusoidal form. By means of the pressure difference, there is imparted to the fluid an alternating speed with respect to the pipe of the active circuit and a corresponding alternating flow of fluid. The active circuit can therefore be connected, through the fixed inlet and outlet, with an outer circuit.

The mode of operation of the hydraulic machine according to the invention is characterized by the fact that the sum of the average values of the hydraulic power and of the mechanical power is always equal to zero. Consequently the hydraulic machine according to the invention can be used for the exchange of hydraulic power with mechanical power of any other system.

More particularly, the hydraulic machine according to the invention can be used as a pump, provided that with the active circuit of the oscillating rotor there is associated at least one non-return valve, which causes a unidirectional flow of the fluid.

As mentioned above, the hydraulic machine according to the invention can be used as torque transducer between a driving motor and a utilizer, in combination with a hydraulic motor connected to both extremities of the active circuit and driven by the alternating pressure.

The hydraulic machine according to the invention can produce very high pressures and presents a high degree of efficiency, inasmuch as the losses are practically limited to the low losses in the flow of the fluid and to the friction losses associated with the bearings of the moving parts of the machine.

The hydraulic machine according to the invention presents a very simple construction, while practically there arise no problems of tight sealing between the moving and the fixed parts of the machine itself, since the connection of the extremities of the active circuit with the oscillating rotor, which extremities are entrained into rotary oscillation movement together with the rotor, is obtained in a very simple manner, by the provision of flexible hose portions which connect the extremities with the fixed inlet and the fixed outlet.

The above and other features of the hydraulic machine object of the present invention will be clearly understood from the following description of one preferred embodiment thereof, made with reference to the accompanying drawings, and the novel features will be particularly pointed out in the appended claims.

DESCRIPTION OF THE PREFERRED EMBODIMENT

Figure 1:
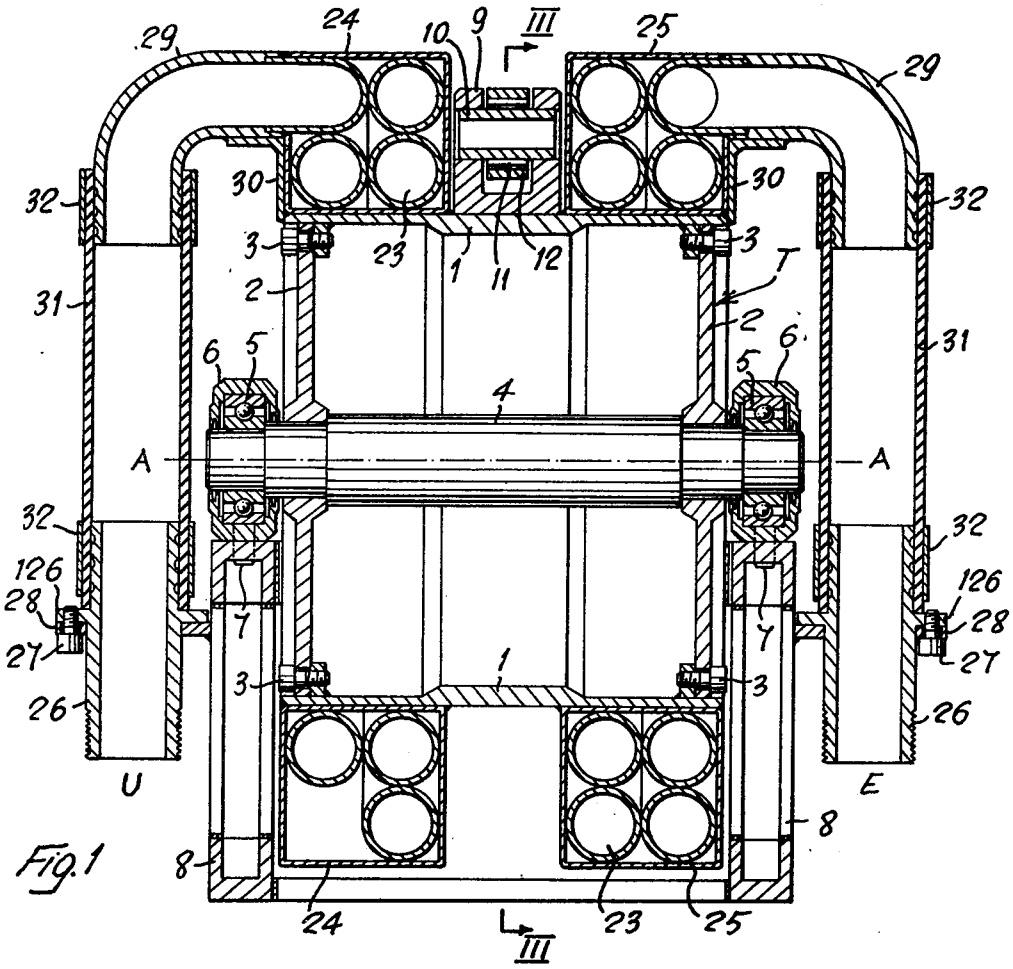
FIG. 1 is a vertical section along the axis of the oscillating rotor of a hydraulic machine according to the invention.
Figure 2:
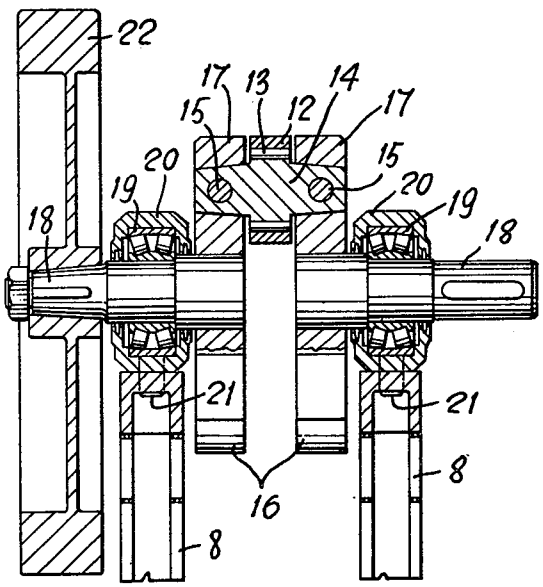
FIG. 2 is a vertical section along the axis of the crank shaft of the crank mechanism for driving the oscillating rotor.
Figure 3:
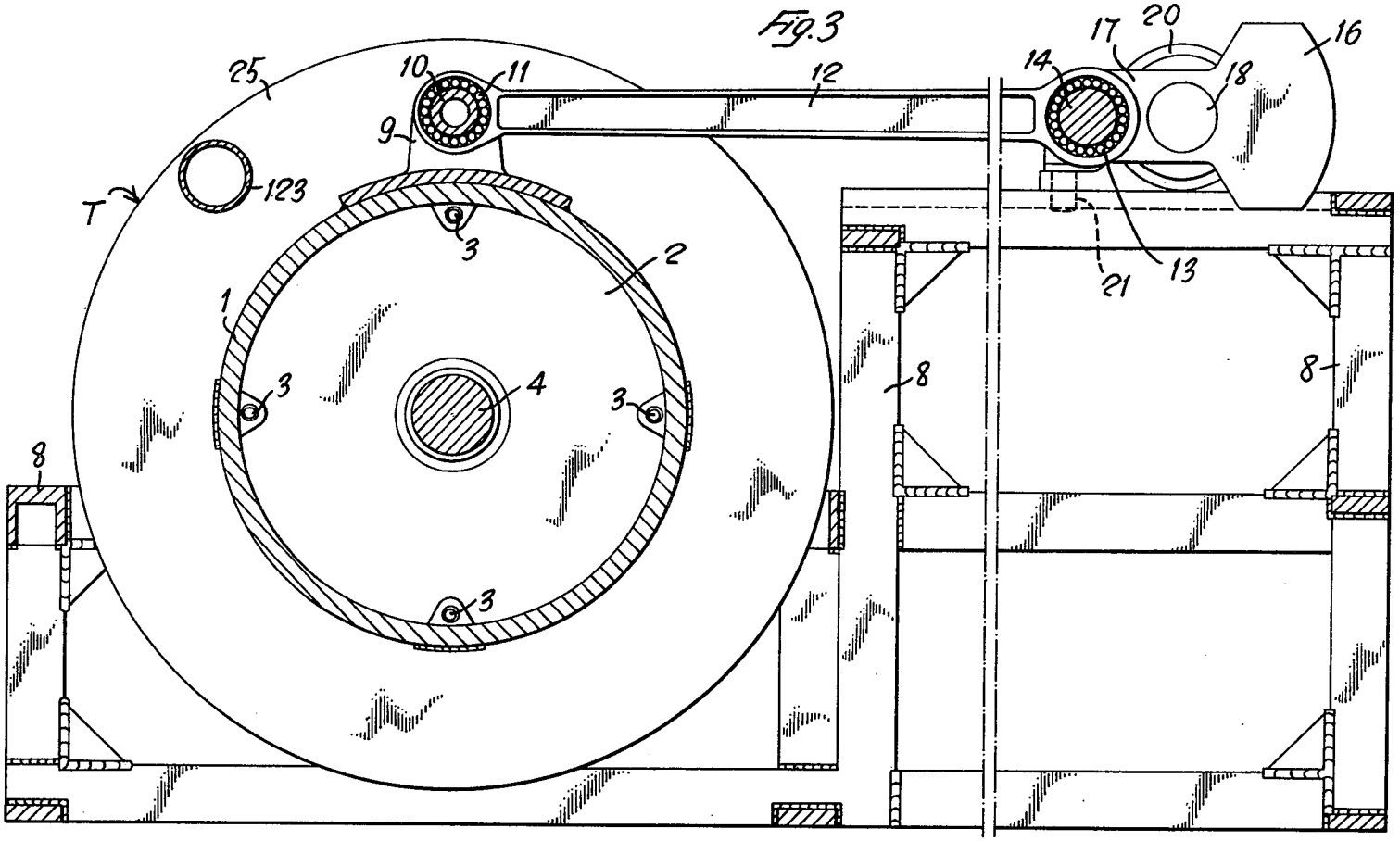
FIG. 3 is a transverse section of the hydraulic machine, taken along line III—III of FIG. 1.

With particular reference to FIGS. 1 to 3, there will be first described the main component of the hydraulic machine, which consists of a rotor with reciprocating movement, or oscillating rotor T, comprising a cylinder 1 and a pair of disc-shaped cover plates 2 secured to the said cylinder 1 by means of screws 3. The cover plates 2 carry a shaft 4 which is rotatably mounted together with oscillating rotor T on roller bearings 5. The bearing boxes 6 of the roller bearings 5 are secured to the machine frame 8 by means of screws 7.

Figure 9:
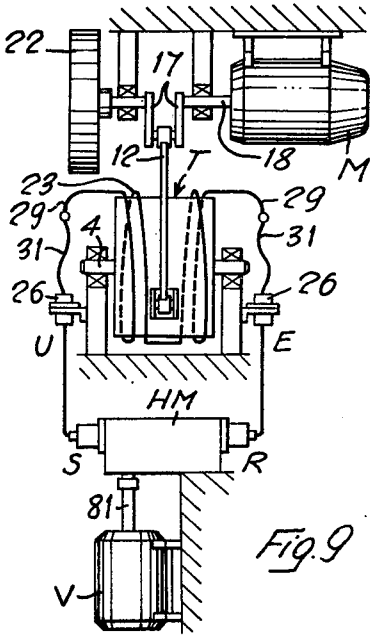
FIG. 9 represents diagrammatically a circuital arrangement showing the use of the hydraulic machine as a torque transducer.
Figure 6:
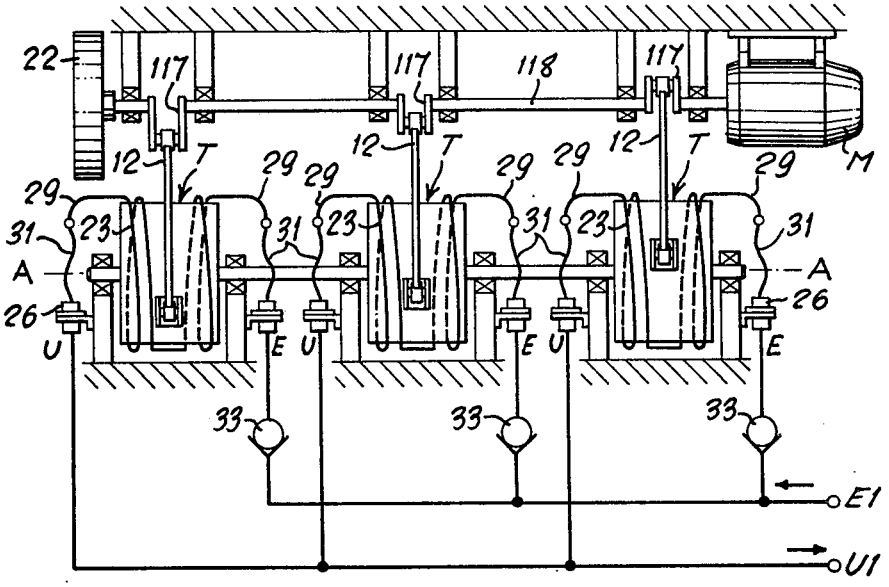

On the outer surface of cylinder 1 there is secured a hinge fork 9, to which there is hingedly connected, by means of a pin 10 and a roller bearing 11, a connecting rod 12. The other end of the connecting rod is linked, with the aid of a roller bearing 13, to the pin 14 of a crank assembly. The crank pin 14 is secured, by means of pins 15, to a pair of crank arms 17, provided with counterweights 16 each having a stub shaft 18. The coaxial stub shafts 18 are supported in roller bearings 19, the boxes 20 of which are secured by means of screws 21 to the machine frame 8. One stub shaft 18 carries a flywheel 22, while the other stub shaft 18 can be coupled with a driving motor M, as illustrated in FIGS. 6 and 9.

Onto cylinder 1 of the oscillating rotor T there is peripherally arranged and secured the active circuit. In the illustrated embodiment, the active circuit consists of a plurality of pipe coils connected in series, arranged one next to another in the direction of the rotational axis A—A of the oscillating rotor T, and one above another in the radial direction, which pipe coils constitute a pipe winding 23. The pipe coils arranged at both sides of the hinge fork 9 are enclosed in an annular casing 24, and 25, respectively and are conncted by means of a pipe section 123 parallel to the rotational axis, as particularly shown in FIG. 3, in which pipe section 123 bridges over the distance between the said two annular casings 24 and 25.

Both ends of the active circuit arranged on the oscillating rotor T are connected with a fixed inlet E and with a fixed outlet U. The inlet E and the outlet U consist each of a pipe piece 26 which is secured to a bracket 28 of the machine frame 8 by means of a flange 126 and screws 27. The extremities of the pipe winding 23 are connected to bent pipe portions 29, which are secured to the cylinder 1 of the oscillating rotor by means of an angle plate 30. Each bent pipe portion 29 is connected, by means of a flexible hose section 31, with the respective pipe section 26 of the inlet E and the outlet U. The ends of the flexible hose section 31 are fitted onto the ends of the bent pipe section 29 and the pipe piece 26 and secured with a tight seal by means of hose clips 32.

In the hydraulic machine according to the just described arrangement, the oscillating rotor T is caused to move with rotary oscillations around the rotational axis A—A by the crank mechanism. The pipe winding 23 which is driven in rotary oscillation motion, is filled with fluid, for example water, and the tight seal connection with the fixed inlet E and outlet U is rendered possible by the flexible hose sections 31, provided that the amplitude of the rotary oscillation is not too great. Of course, instead of the hose portions 31 there can be provided rotary seal devices.

Consequently, during operation, to the oscillating rotor T there is imparted, through the crank mechanism, an alternating angular acceleration $\ddot{\phi}$. When the angular speed of the crank shaft is constant, and under particular geometrical conditions of the kinematic system, it can be assumed with good approximation that the angular acceleration $\ddot{\phi}$ changes sinusoidally. Each particle of fluid contained in the active circuit, i.e. in the pipe winding 23, is subjected therefore to a linear alternating acceleration, which is proportional to the product $\ddot{\phi}\cdot r$ of the above mentioned angular acceleration $\ddot{\phi}$ and to the distance "r" from the rotational axis of the oscillating rotor T. The components of the forces of inertia generated by the linear alternating acceleration, which components are directed tangentially with respect to the curved longitudinal axis of the pipe winding 23, produce between the ends of the said pipe winding 23, i.e. between the inlet E and the outlet U, a pressure difference "p" which is proportional to the product $S\cdot\ddot{\phi}$. S represents the surface which is delimited by the projection of the longitudinal median axis of the pipe winding 23 onto a plane which is perpendicular to the rotational axis A—A of the oscillating rotor T.

The pressure difference "p" tends to impart to the fluid contained in the pipe winding 23 an alternating flow speed "v" with respect to the pipe walls. The flow speed "v" depends upon the hydraulic resistance in the pipe winding 23 and upon the counterpressure in the outer circuit, connected by means of the inlet E and the outlet U. The flow speed "v" is not uniform, and therefore the fluid particles contained in the active circuit, i.e. in the pipe winding 23, are subjected to an acceleration "$\dot{v}$". The torque $\mu$, which is produced by the forces of inertia corresponding to the acceleration "$\dot{v}$" with respect to the rotational axis A—A of the oscillating rotor T, can consequently brake or accelerate the rotary oscillation of the rotor T, depending upon the sign of the torque $\mu$ and the angular speed $\dot{\phi}$ of the oscillting rotor T around the rotational axis A—A. The sum of the average values of the powers $p\cdot q$ and $\mu\cdot\dot{\phi}$ is always equal to zero, where "q" is the rate of flow in the active circuit of the oscillating rotor T, i.e. $q=F\cdot v$ (F=inner cross sectional area of the active circuit). The power $\mu\cdot\dot{\phi}$ is transmitted to the crank shaft 18. The driving motor M of the crank mechanism supplies to the machine the same power $\mu\cdot\dot{\phi}$ and acts to compensate for the losses in the machine.

Figure 4:
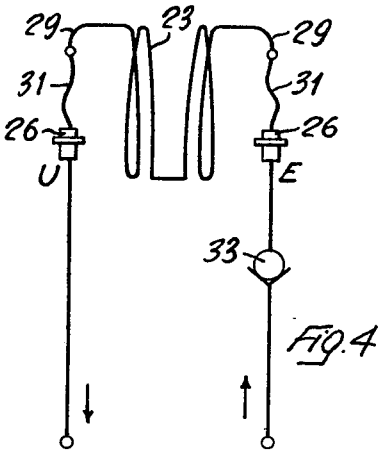
FIGS. 4 to 8 represent diagrammatically several different circuital arrangements in which the hydraulic machine according to FIGS. 1 to 3 is used as a pump.

The hydraulic machine according to the invention can be used as a pump, and many different embodiments are possible. The simplest arrangement consists of the provision of a non-return valve 33 in the line leading from the inlet E, as diagrammatically illustrated in FIG. 4.

Figure 5:
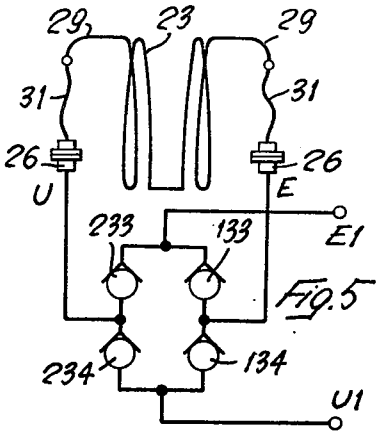

The efficiency, i.e. the average values of the capacity and the feed pressure of the hydraulic machine according to the invention used as a pump, can be substantially increased by the arrangement shown in FIG. 5. By this arrangement, an inflow duct E1 is connected, by means of two non-return valves 133 and 233, respectively, opening in the inflow direction, and arranged in parallel, both with the inlet E and with the outlet U of the active circuit, i.e. of the pipe winding 23. An outflow duct U1 is similarly connected, by means of two non-return valves 134 and 234, respectively, both with the inlet E and with the outlet U. With this "bridge circuit" arrangement, the fluid flows constantly into the inflow duct E1 and out of the outflow duct U1, independently from the alternating direction of the flow at the interior of the active circuit.

Figure 7:
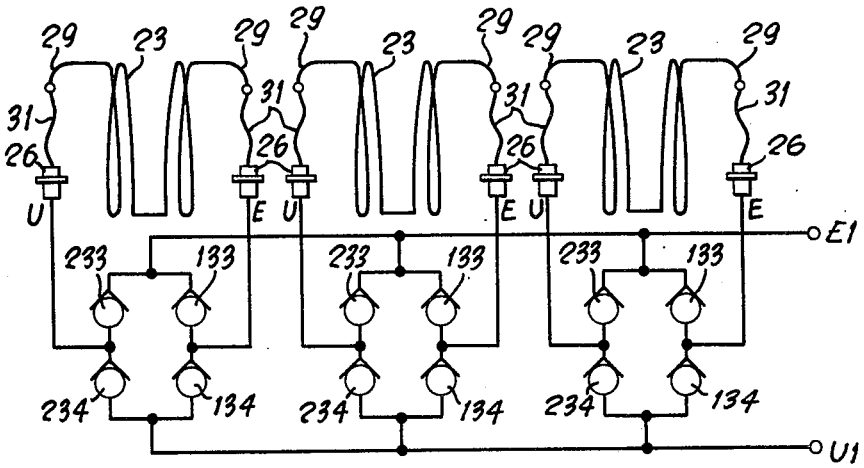

The delivery fluctuations of a hydraulic machine according to the invention are levelled by the arrangement shown in FIG. 7, in which there is shown the operational coupling of a plurality of oscillating rotors T arranged co-axially one next to the other. In this case, the oscillating rotors T are each connected to a common crank shaft 118 by means of a connecting rod 12 and corresponding angularly offset cranks 116. The crank shaft 118 presents a flywheel 22 and is driven by a motor M as shown in FIG. 6. The inlets E and the outlets U of the active circuits, i.e. the pipe windings 23 of the single oscillating rotors T, are connected in parallel with a common inflow duct E1, and a common outflow duct U1, respectively. In the arrangement shown in FIG. 6, the outlets U of the pipe windings 23 are connected directly to the outflow duct U1, while the inlets E are connected to the inflow duct E1 through non-return valves 33 opening in the direction of the inflow.

According to the arrangement shown in FIG. 7, the efficiency of the active circuits of the oscillating rotors T1 coupled one to another, and the average values of the capacity and feed pressure, can be substantially increased by adopting a "bridge circuit" connection of non-return valves. More particularly, a common inflow duct E1 is connected by means of non-return valves 133, 233, respectively, opening in the inflow direction, both with the inlet E and with the outlet U of each single oscillating rotor T. Correspondingly, a common outflow duct is connected by means of non-return valves 134, 234, respectively, opening in the outflow direction, both with the inlet E and with the outlet U of each single oscillating rotor T. The pipe winding 23 of each single oscillating rotor is therefore connected, by means of a bridge circuit consisting of the non-return valves 133, 233, 134, 234, with the inflow duct E1 and with the outflow duct U1.

Figure 8:
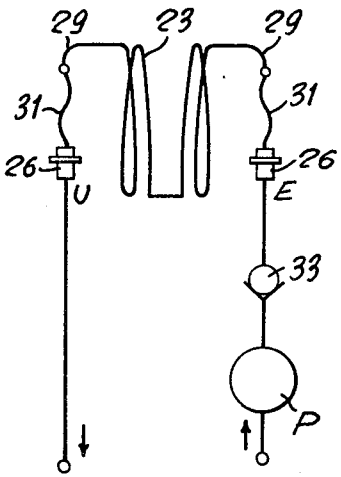

The speed and consequently the specific capacity of the hydraulic machine according to the invention, can be additionally improved by increasing the intake pressure in the line leading to the inlet end of the active pipe winding 23, by the aid of a boost feed pump P, as shown in FIG. 8.

The hydraulic machine according to the invention can also be used as a torque transducer between the driving motor M and a utilizer V. To this purpose, it is necessary to have a hydraulic motor HM which can be driven by a pressure difference which changes almost sinusoidally; such a hydraulic motor is described, for example, in the aforementioned U.S. application No. 886,924 pending in the name of the same applicant. A circuit diagram showing this arrangement is illustrated in FIG. 9. According to this arrangement, the inlet E and the outlet U of the hydraulic machine according to the present invention are connected with the connections R and S, respectively, of the hydraulic motor HM. An output shaft 81 of the hydraulic motor HM is coupled to the utilizer V. The mechanical power from the driving motor M to the rotor T is converted, by the hydraulic machine according to the invention, into hydraulic power which is available at the extremities E and U of the active circuit, i.e. the pipe winding 23 of the rotor T, and which then can be transmitted through the hydraulic motor HM to the utilizer V in the form of controlled mechanical power. Referring to the arrangement shown in FIG. 6, where there is provided a plurality of rotors T driven by a common crank shaft 117, 118, the extremities E and U of the active circuits of each single rotor T can be connected each with a hydraulic motor HM or with a plurality of hydraulic motors HM of the same type.

I claim:

1. A hydraulic machine, which can be used at will as a pump or as a torque transducer, comprising: (a) an oscillating rotor rotatably mounted on a machine frame around a rotational axis, and which can be driven with reciprocating movement; (b) an active pipe circuit filled with fluid secured onto the oscillating rotor, said pipe circuit being curved in such a manner that the projection of its longitudinal axis onto a plane which is perpendicular to the rotational axis of the oscillating rotor defines a surface which increases with the length of the longitudinal axis of said active pipe circuit; and (c) means for sealingly connecting the extremities of said active pipe circuit with a fixed inlet and a fixed outlet, whereby the fluid contained in said active pipe circuit is subjected to a linear alternating acceleration which corresponds to the product of the alternating angular acceleration of the rotary oscillation of the rotor and the distance of the fluid from the rotational axis of said oscillating rotor, and which produces between the ends of said active pipe circuit and more particularly between said fixed inlet and said fixed outlet, a pressure difference in the fluid, said pressure difference correspondingly varying in an almost sinusoidal manner.

2. A hydraulic machine according to claim 1, in which the extremities of the active pipe circuit are connected with the fixed inlet and the fixed outlet by means of flexible hose portions.

3. A hydraulic machine according to claim 1, in which said active pipe circuit consists of at least a partial pipe coil.

4. A hydraulic machine according to claim 1, in which the oscillating rotor is driven with rotary oscillations by a crank mechanism.

5. A hydraulic machine according to claim 4, in which a plurality of oscillating rotors are driven by a common crank shaft through angularly offset crank mechanisms.

6. A hydraulic machine according to any one of claims 1 to 5, being used as a pump, in which said active pipe circuit includes at least one non-return valve which determines an undirectional flow of the fluid.

7. A hydraulic machine according to any one of claims 1 to 5, being used as a pump, in which the active pipe circuit is associated with a bridge circuit arrangement of non-return valves, whereby an inflow duct is connect both to the inlet and to the outlet through two non-return valves connected in parallel and opening in the inflow direction, and an outflow duct is connected both to the inlet and to the outlet through two non-return valves connected in parallel and opening in the outflow direction.

8. A hydraulic machine according to claim 1, being used as a pump, in which a feed or boost pump is connected in series with the inlet of said active pipe circuit.

9. A hydraulic machine according to any one of claims 1 to 5, being used as a torque transducer, in which the extremities of said active pipe circuit, and more particularly said fixed inlet and outlet, are connected with the connections of a hydraulic motor, wherein said hydraulic motor is driven by means of a pressure varying in an almost sinusoidal manner, said hydraulic motor being coupled to a utilizer.

* * * * *